US007223220B2

(12) United States Patent
Bendavid et al.

(10) Patent No.: US 7,223,220 B2
(45) Date of Patent: May 29, 2007

(54) EXERCISE DEVICE ATTACHABLE TO CHAIR

(76) Inventors: Joseph Bendavid, 9340 Monte Leon La., Beverly Hills, CA (US) 90210; Hongwei Jia, South sea rose garden, Shekou, Nanshan district, Shenzhen, Guangdong (CN)

( * ) Notice: Subject to any disclaimer, the term of this patent is extended or adjusted under 35 U.S.C. 154(b) by 0 days.

(21) Appl. No.: 11/287,266

(22) Filed: Nov. 28, 2005

(65) Prior Publication Data

US 2006/0281612 A1 Dec. 14, 2006

(30) Foreign Application Priority Data

Jun. 8, 2005 (CN) ..... 2005 2 0109500

(51) Int. Cl.
*A63B 21/02* (2006.01)
*A63B 21/04* (2006.01)

(52) U.S. Cl. ..... 482/130; 482/121; 482/126; 482/904

(58) Field of Classification Search ..... 482/121–4, 482/126, 129, 130, 904, 142, 62; D21/665, D21/690

See application file for complete search history.

(56) References Cited

U.S. PATENT DOCUMENTS 2,817,184 A * 12/1957 Inouye ..... 446/489
3,509,660 A * 5/1970 Seymour ..... 446/38
4,836,818 A * 6/1989 Piolata ..... 446/236
5,145,443 A * 9/1992 Vaisnys et al. ..... 446/242
5,599,260 A * 2/1997 Rovinsky et al. ..... 482/121
6,059,632 A * 5/2000 Sassak ..... 446/236
6,890,238 B2 * 5/2005 Kessler ..... 446/236
7,056,269 B2 * 6/2006 Cleveland et al. ..... 482/148

* cited by examiner

*Primary Examiner*—Jerome Donnelly
*Assistant Examiner*—Allana Lewin
(74) *Attorney, Agent, or Firm*—Rosenberg, Klein & Lee

(57) ABSTRACT

An exercise device attachable to the chair is provided which comprises a generally "W"-shaped frame separately mounted on a post of a height-telescopic executive type chair, an elastic band disposed and extending through the W-shaped frame, and a tension adjusting mechanism mounted on the chair and connected to the elastic band. The adjusting mechanism is manipulated to adjust the tension of the elastic strap. The exercise device mounted on the executive chair creates a unique and most serious exercise-station at one's home or office. The tension adjusting mechanism slides up and down with the motion of the chair, and by this action the tension of the elastic band increase or decrease significantly, making the workout routine a challenge or pleasure as per one's choice.

6 Claims, 2 Drawing Sheets

EXERCISE DEVICE ATTACHABLE TO CHAIR

BACKGROUND OF THE INVENTION

1. Field of the Invention

The present invention relates to an exercise device. More particularly, the present invention relates to a portable exercise device attachable to a chair which employs elastic resistance to strengthen muscles.

2. Description of the Prior Art

We all are in need of keeping in shape, and while most of us are 'stuck' in badly postured chairs worldwide. Increasingly, both at work and leisure, individuals find themselves in seated positions for extended periods with little or no opportunity for physical activity and with a resultant diminution of their faculties.

Accordingly, there is a need for a device for providing stimulating activity in the form of exercise to individuals to be seated over extended periods.

SUMMARY OF THE INVENTION

The present invention comprises a device for performing resistance exercises. The exercise device is provided which comprises a generally "W"-shaped frame separately mounted on a post of a height-telescopic executive type chair, an elastic band disposed and extending through said W-shaped frame, and a tension adjusting mechanism mounted on said chair and connected to said elastic band wherein said adjusting mechanism is manipulated to adjust the tension of said elastic band.

The exercise device mounted on the telescopic height adjuster of an executive chair creates a unique and most serious exercise-station at one's home or office. The tension adjusting mechanism slides up and down with the chair, and by this action the tension of the elastic band increase or decrease significantly, making the workout routine a challenge or pleasure as per one's choice.

The exercise device has a dual function capacity: by lifting the two grips connected to the rubber bands up and down by hands, the exercise device allows full and correct performance-routine for most upper body exercises; there is also anther function of the present invention that allows tension exercise in same manner for legs by working forward and backward with the grips by legs.

While not in use, the exercise device of the present invention tucks away and hides from plain sight and allows a 'hidden-gym' to be mounted on an executive type chair at home/office use and avoids the all too common & ugly home-exercise-machines that ultimately become expensive 'coat hangers' in most home and garages.

DETAILED DESCRIPTION OF THE PREFERRED EMBODIMENT

Figure 1:
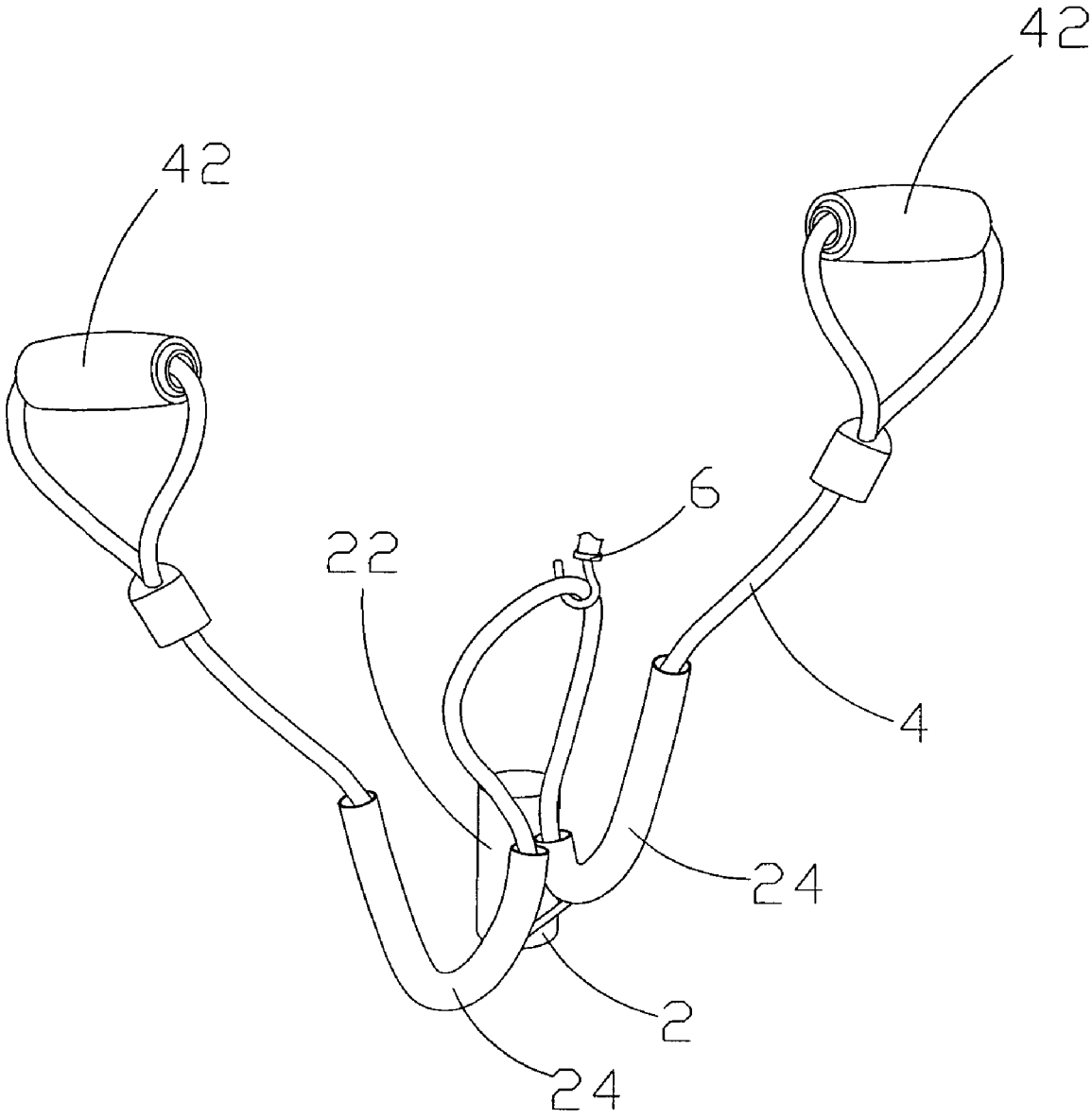
FIG. 1 is a perspective illustration of an exercise device of the present invention.
Figure 2:
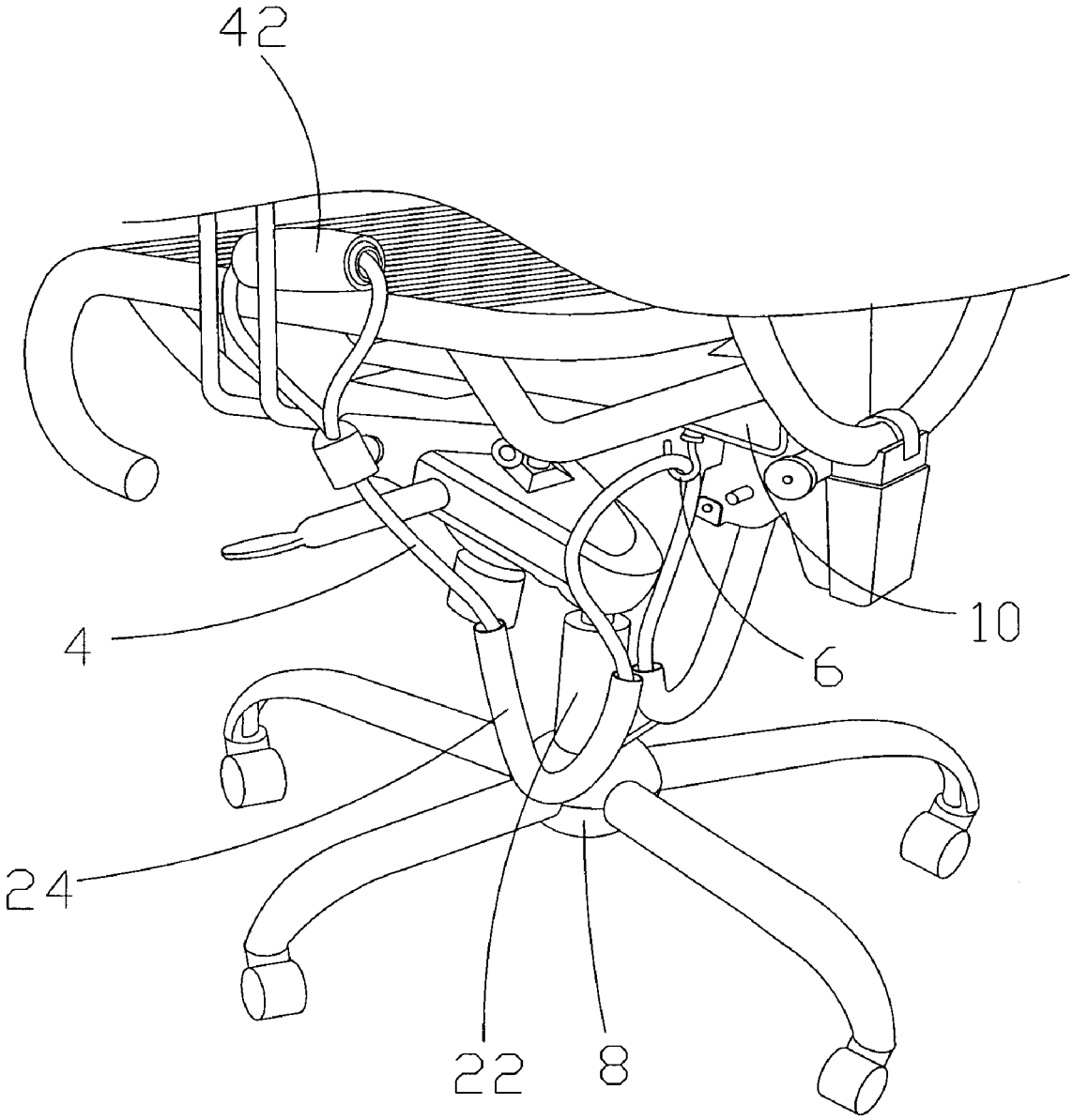
FIG. 2 is a perspective illustration of an exercise device according to the present invention attached to a chair.

Referring to FIGS. 1 and 2, the device includes a W-shaped frame 2, an elastic band 4 and a tension adjusting mechanism 6. The elastic band 4 runs through the W-shaped frame 2 and the tension adjusting mechanism 6.

The W-shaped frame 2 includes a base member 22 and two "V"-shaped tubular members 24. The two "V"-shaped tubular members 24 are mounted on the base member 22 symmetrically. In the embodiment, the base member 22 is a cylindrous base separately mounted around the post of a height-telescopic executive chair. The elastic band 4 is inserted through the two "V"-shaped tubular members 24.

Each of two ends of the elastic band 4 connects a handgrip 42 for user's holding.

In the embodiment, the tension adjusting mechanism 6 is a hook mounted on the bottom of the seat 10 of the executive chair. The height of the seat 10 is adjustable. By means of adjusting the height between the seat 10 and the undercarriage 8 of the chair, the distance between the tension adjusting mechanism 6 and the W-shaped frame 2 can be adjusted and the tension of the elastic band 4 also can be adjusted.

The present invention meets the need to be able to do exercise while working or on break without leaving the chair, and saves time and costs for same purposes elsewhere.

While the present invention has been described in connection with the preferred embodiment of the various figures, it is to be understood that other similar embodiments may be used or modifications and additions may be made to the described embodiment for performing the same function of the present invention without deviating therefore. Therefore, the present invention should not be limited to any single embodiment, but rather construed in breadth and scope in accordance with the recitation of the appended claims.

What is claimed is:

1. An exercise device comprising:

a height-telescopic chair having a post:

a generally "W"-shaped frame separately mounted on the post of the height-telescopic chair;

an elastic band disposed and extending through said W-shaped frame; and a tension adjusting mechanism coupled to a center of said W-shaped frame, said tension adjusting mechanism being coupled to the height-telescopic chair wherein a height of the height-telescopic chair is manipulated to adjust a tension of said elastic band.

2. The exercise device according to claim 1, wherein said "W"-shaped frame includes a base member and two "V"-shaped tubular members mounted on said base member symmetrically to form said "W"-shape frame, wherein said elastic band disposed and extending through said two "V"-shaped tubular members.

3. The exercise device according to claim 2, wherein said base member is a cylindrous base mounted around the post of said chair.

4. The exercise device according to claim 2, wherein said tension adjusting mechanism comprises a hook mounted on a bottom of a seat of the chair, wherein part of said elastic band between said two "V"-shaped tubular members disposed through said hook.

5. The exercise device according to claim 1, further comprising a pair of hand grips mounted on two ends of said elastic band for user's holding.

6. An exercise device attached to a height-telescopic chair having a post, comprising:

a generally "W"-shaped frame separately mounted on the post of the height-telescopic chair, wherein said "W"-shaped frame includes a base member configured to attach to the post of the height-telescopic chair and two "V"-shaped tubular members symmetrically mounted on said base member to form said "W"-shaped frame;

an elastic band disposed and extending through said two "V"-shaped tubular members; and a tension adjusting mechanism coupled to a center of said W-shaped frame, said tension adjusting mechanism being coupled to the height-telescopic chair wherein a height of the height-telescopic chair is manipulated to adjust a tension of said elastic band.

* * * * *